United States Patent [19]

Müller et al.

[11] 3,955,667

[45] May 11, 1976

[54] ENDLESS CONVEYOR WITH GRIPPING ELEMENTS

[75] Inventors: Erwin Müller, Durnten; Werner Honegger, Ruti, both of Switzerland

[73] Assignee: Ferag AG, Hinwil, Switzerland

[22] Filed: May 27, 1975

[21] Appl. No.: 580,899

[30] Foreign Application Priority Data

May 28, 1974 Switzerland ..... 7233/74

[52] U.S. Cl. ..... 198/180; 271/204; 294/103 R; 294/104; 214/1 BA

[51] Int. Cl.[2] ..... B65G 19/00

[58] Field of Search ..... 198/179, 180, 34; 271/204–206, 277, 202; 214/1 BA; 294/103, 104

[56] References Cited

UNITED STATES PATENTS

| | | | |
|---|---|---|---|
| 3,671,035 | 6/1972 | Reist | 271/204 |
| 3,809,214 | 5/1974 | Reist | 271/204 |

*Primary Examiner*—Evon C. Blunk
*Assistant Examiner*—Joseph E. Valenza
*Attorney, Agent, or Firm*—Werner W. Kleeman

[57] ABSTRACT

A transport apparatus for printed products arriving in an imbricated formation, said transport apparatus comprising grippers or gripper elements anchored in spaced relationship from one another at a revolving traction element for engaging the leading edges of the printed products and for the transfer thereof for further conveying of such printed products. At a transfer zone the conveyor track of the imbricated product stream and a guide for the grippers extend in a direction towards one another. Each gripper comprises a guided upper clamping tongue or jaw and a lower clamping tongue or jaw which is mounted to be movable towards and away from the upper clamping jaw as well as being rotatably mounted. This lower clamping tongue or jaw, when assuming its open position, forms an angle together with the upper clamping jaw which is rearwardly directed and in its closed position the lower clamping jaw is held in a position which is in alignment with or underlies the upper clamping jaw by a holding device of the gripper. At the transfer zone there are provided means for positionally moving the lower clamping jaw into its closed position by rotation and displacement thereof, and along the path of movement of the grippers there are arranged further means in order to render the holding device ineffectual and to return the lower clamping jaw back into its open position.

18 Claims, 14 Drawing Figures

ENDLESS CONVEYOR WITH GRIPPING ELEMENTS

BACKGROUND OF THE INVENTION

The present invention broadly relates to product handling equipment and, more particularly, is directed to a new and improved construction of a transport apparatus for printed products or the like which arrive in an imbricated or so-called "fish scale" arrangement, the transport apparatus comprising grippers anchored in spaced relationship from one another at a revolving traction or tension element, these grippers serving to engage the leading edges of the printed products and for the transfer thereof in order to permit the further conveying or transport of such engaged printed products, and wherein at the transfer zone or region the conveyor track or path of the imbricated product stream and a guide for the grippers extend towards one another.

It is to be understood that in the context of this disclosure the term "fish scale" arrangement as employed in conjunction with the printed products is intended to mean an arrangement of typically flat structures which are disposed in an overlying spread stacked formation, in other words, in the manner of a fanned deck of cards. Also the term "printed products" is used in its broader sense as relating to various type of structures capable of being handled with the transport or conveying apparatus of the development, there being specifically mentioned, by way of example and not limitation, newspapers, periodicals, magazines and so forth.

SUMMARY OF THE INVENTION

It is a primary object of the present invention to provide an improved construction of transport apparatus for printed products arriving in an imbricated product formation, and which apparatus is capable of reliably and positively engaging the printed products for further transport thereof.

Still another significant object of the present invention aims at the provision of a novel construction of transport or conveying apparatus equipped with grippers for seizing conveyed articles or the like in an extremely efficeint, rapid efficient, safe manner for the further transport thereof.

Another object of this invention relates to a new and improved construction of transport apparatus for articles employing gripper means for engaging the conveyed articles to permit separation thereof from an imbricated stream of such articles and for the further transport thereof, and which apparatus is extremely reliable and efficient in operation, economical to manufacture, not readily subject to malfunction or breakdown, and requires a minimum of servicing and maintenance.

Now in order to implement these and still further objects of the invention, which will become more readily apparent as the description proceeds, the transport or conveying apparatus, hereinafter simply referred to as the transport apparatus, of this development is manifested by the features that each gripper or gripper element comprises a guided upper clamping tongue or jaw and a lower clamping tongue or jaw. The lower clamping jaw is mounted so as to be movable towards and away from the upper clamping jaw as well as being rotatably mounted. Further, the lower clamping jaw, when in its open position, forms together with the upper clamping jaw which is rearwardly directed an angle, and in the closed position of the lower clamping jaw the same is held in a position underlying the upper clamping jaw by means of a holding or holder device of such gripper. At the transfer zone or region of the apparatus there are provided means in order to position the lower clamping jaw in its closed position by rotation and displacement thereof. Further, along the path of movement or travel of the grippers there are provided further means in order to render ineffectual or disengage the holding or holder device and to return the lower clamping jaw of the relevant gripper back into its open position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 9 illustrates a detail of such embodiment of gripper;

DETAILED DESCRIPTION OF THE INVENTION

Figure 1:
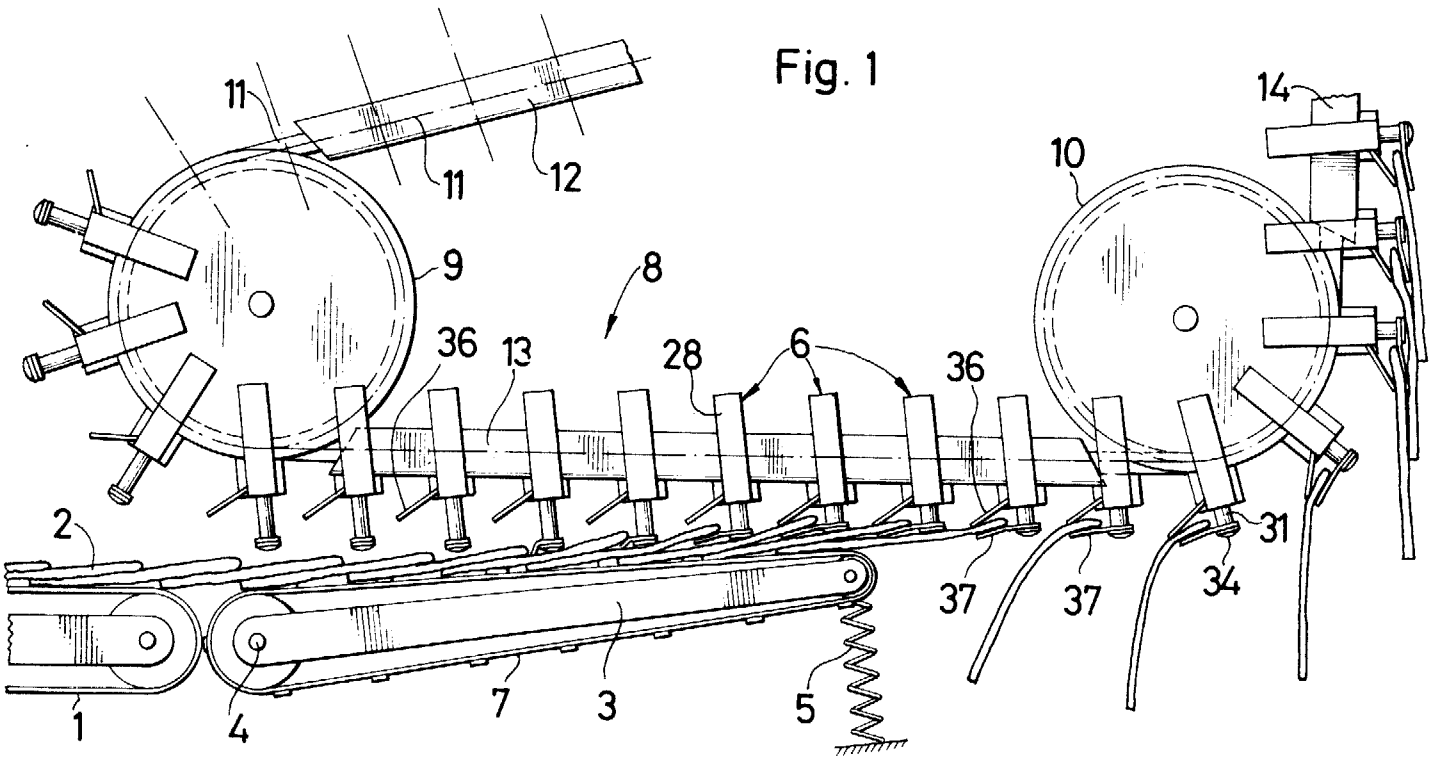
FIG. 1 schematically illustrates in side view a receiving station of the transport apparatus of this development at the transfer zone or region.

Describing now the drawings, and as will be apparent by referring to FIG. 1, the copies 2 of the imbricated product stream are delivered by means of a transport or conveyor band 1 or the like to a conveyor band 7 at the receiving or take-up station which has been conveniently designated in its entirety by reference character 8. The conveyor band 7 or equivalent structure is mounted upon a rocker or balance arrangement 3. This balance or rocker arrangement 3 is mounted upon a shaft 4 and is upwardly pivoted or rocked together with the imbricated stream of products 2 under the action of a spring 5 or other equivalent structure. Above the balance or rocker arrangement 3 there is located a guide or guide means 13 within which there is quided a sprocket chain 11 which is trained about a sprocket gear or wheel 9. Before the sprocket chain 11 runs onto the sprocket wheel or gear 9 it travels in a further guide or guide means 12. Following the guide means 13 the sprocket chain 11 or the like is deflected via a further sprocket gear or wheel 10 into a still further guide or guide means 14.

Continuing, it will be recognized that at the sprocket chain 11 there are mounted at a predetermined spacing from one another a multiplicity of grippers or gripper elements which have been designated in their entirety by reference character 6. The sprocket chain 11 thus defines a transport member for the grippers or gripper elements 6. As far as each such gripper element 6 is concerned it will be seen that the same comprises an upper clamping jaw or tongue 36 which is rearwardly directed with regard to the direction of movement of such grippers as well as a lower clamping jaw or tongue 37 which, when the same assumes its open position, forms together with the upper clamping jaw 36 an angle. This is the case for the grippers or gripper elements 6 which are located at the starting section or portion of the guide means 13, wherein it is to be appreciated that the lower clamping jaws 37 are directed rearwardly away from the observer looking at the arrangement of FIG. 1, and thus, are not visible in the showing of FIG. 1. Through the provision of measures, which will be discussed more fully hereinafter, there is insured that the lower clamping jaws 37 are brought into a position which so-to-speak underlies or coincides with its coating clamping jaw 36 in order to be able to positively engage the leading edge of the article or product 2. This operational condition has been shown for the grippers 6 which are located at the region of the terminal or end section of the guide means 13 shown at the right-hand side of FIG. 1. As will be apparent from the drawing, the entire operation is brought about in such a manner that by virtue of the course of the conveyor band 7 and the guide means 13 which extend convergingly towards one another, as shown, the upper clamping jaws 37 are progressively lowered in the direction of the products 2 and in each instance come to bear at the region of the leading edge of one such product. However, shortly beforehand a bulbous or substantially mushroomshaped end or terminal piece 34 of a shaft 31 carrying the lower clamping jaw 37 comes into contact with the leading edge of the forwardly neighboring product copy in the direction of travel of the imbricated product formation and presses such edge slightly downwardly. Hence, and as best seen by referring to FIG. 1, the leading edge of one of the articles or products which is to be engaged is somewhat freely exposed, so that the lower clamping jaw 37 of the relevant gripper 6 upon being rotated into its closed position slightly engages beneath the relevant leading edge of such product 2. With the embodiment illustrated in FIG. 1, and as will be explained more fully hereinafter the arrangement is undertaken such that the shaft 31 of each gripper 6 is pushed into the gripper housing due to the action of the resistance of the balance or rocker arrangement 3, and the rotation of the lower clamping jaw 37 into the closed position occurs due to the relative movement of the shaft 31 and the associated gripper housing 28. As will be also further explained, measures are provided which insure that the lower clamping or clamp jaw 37 is retained in its closed position, and one of such measures can be perfected by providing a resilient or elastic construction of the clamp jaw 36 and/or the clamp jaw 37.

Figure 2:
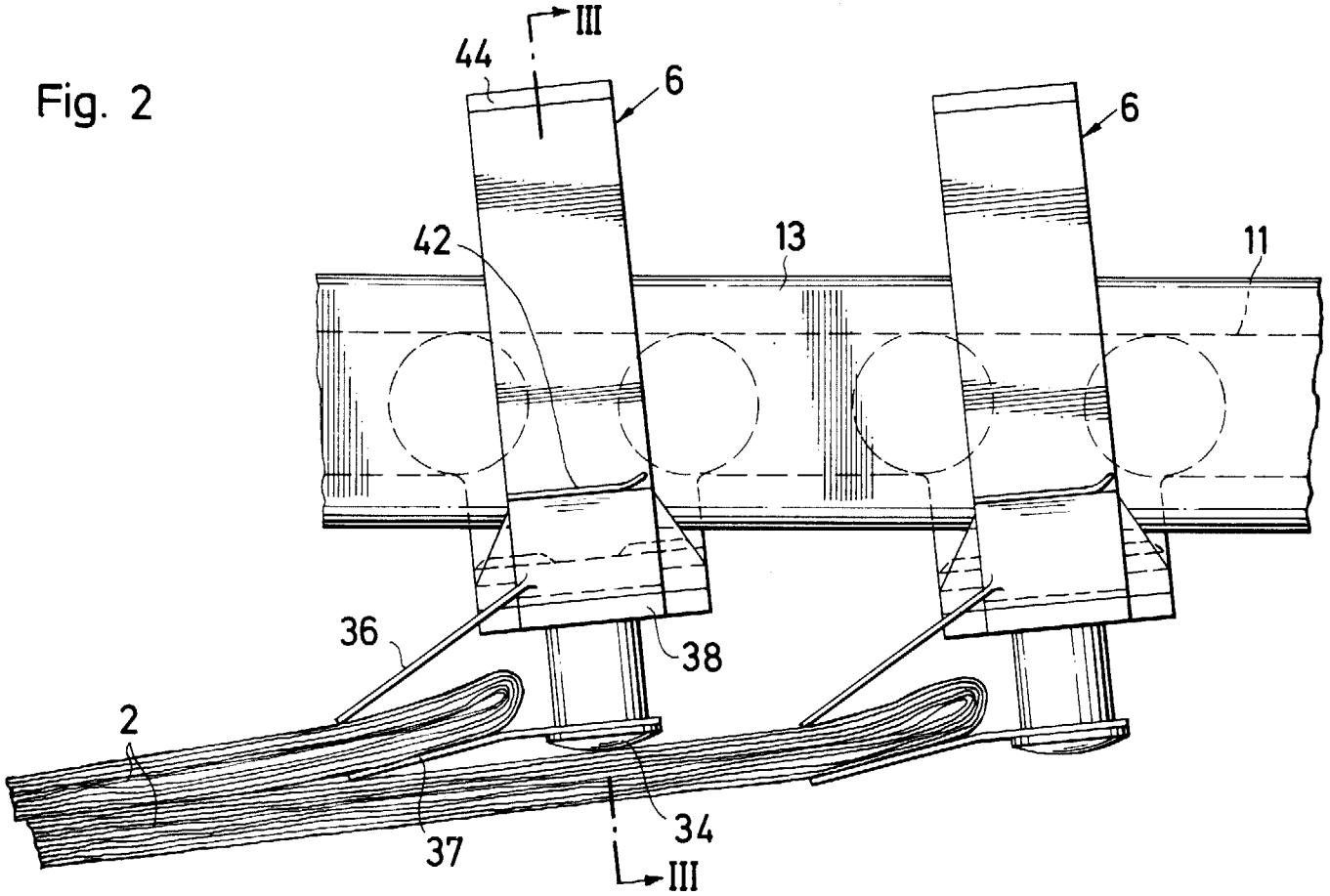
FIG. 2 illustrates on an enlarged scale details of components of the apparatus shown in FIG. 1.

In the closed position of each of the grippers or gripper elements 6 the clamp or clamping jaws 36, 37 thereof freely fixedly yet releasably retain the relevant product and such grippers then are responsible, for instance, for the further conveying or transport of the imbricated product stream. This will be readily recognized by referring to the right-hand portion of the showing of FIG. 1. In order to more fully comprehend the preceding discussion reference is still further made to FIG. 2 which shows on an enlarged scale how the products are held in each instance by the clamping or clamp jaws 36 and 37 of the individual grippers or gripper elements 6. Continuing, at this point reference will be made both to the showing of FIG. 2 and that of FIG. 3 wherein there is portrayed on an enlarged scale a gripper or gripper element in cross-sectional view and in its open position.

Figure 3:
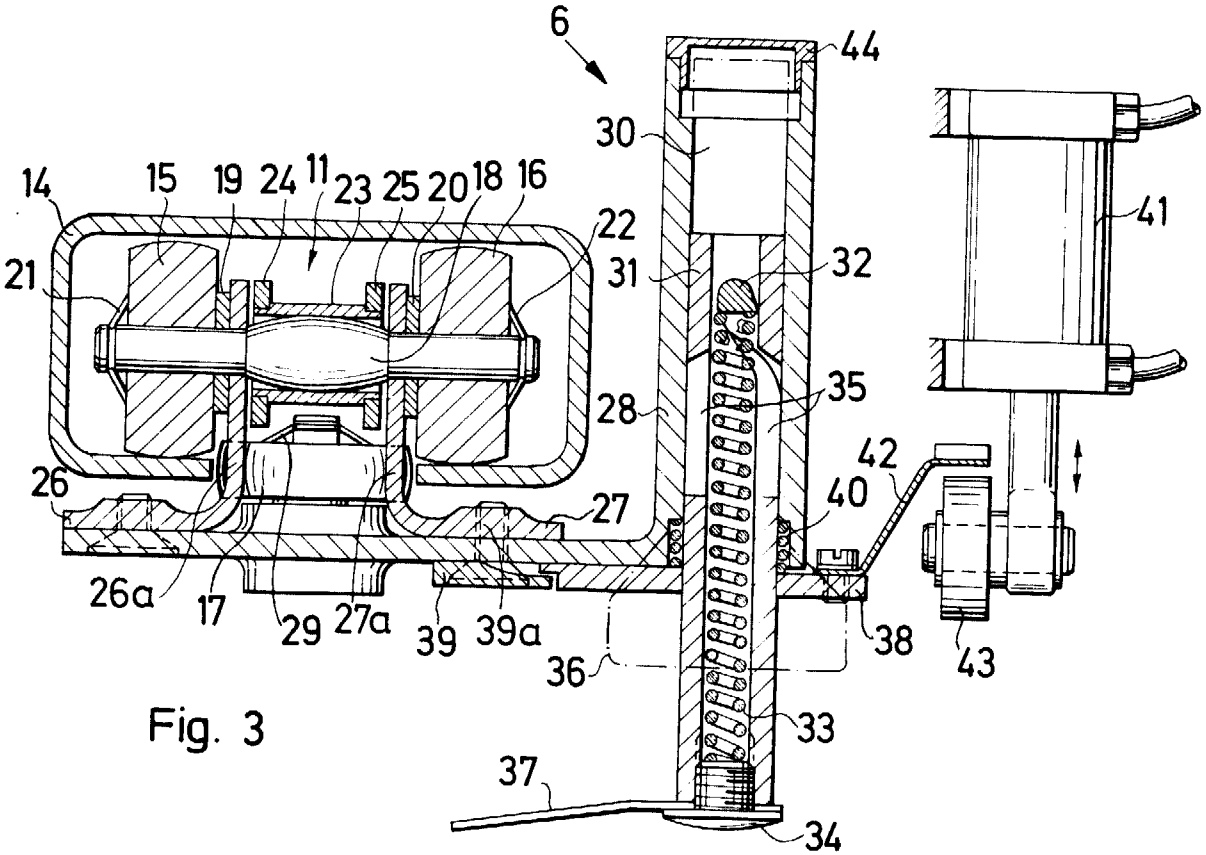
FIG. 3 is a cross-sectional view of the arrangement shown in FIG. 2, taken substantially along the line III—III thereof.

Now the gripper 6 illustrated by way of example in FIG. 3 is located at a section of the guide means 14 which is no longer visible in the showing of FIG. 1 and which merges at the transfer section or portion of the system where the products are deposited or are transferred to another conveyor device or, however, a processing machine or the like. The guide means 14 as well as also the remaining guide means, is advantageously constructed in the form of a hollow rail possessing a substantially C-shaped cross-sectional configuration. The sprocket chain 11, which can be constructed as a so-called side-band chain (arcuate chain), is guided in vertical direction by the rollers 15 and 16 and in horizontal direction by the rollers 17. The rollers 15 and 16 are mounted to be freely rotatably upon the bolts 18 and are retained against axial displacement by the spacer disks 19 and 20 and the securing disks 21 and 22. Furthermore, upon the depicted bolt or bolt member 18 there is mounted a chain bushing 23 and upon such the chain brackets 24 and 25. Moreover, the bolt member 18 carries the bracket or plate members 26 and 27 which extend by means of their elongated legs 26*a* and 27*a*, respectively, through the not particularly referenced slots of the guide rail 14 and are fixedly threaded or otherwise connected with the gripper or clamp housing 28. At this gripper housing 28 there is moreover mounted the already mentioned roller or roll 17 which is retained against axial displacement by a securing disk 29.

Figure 4:
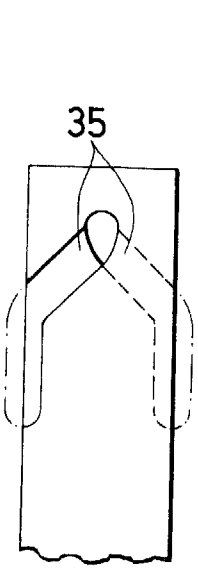
FIG. 4 illustrates a detail of the arrangement portrayed in FIG. 3.

The gripper housing 28 possesses a bore or through-passage 30 in which there is rotatably and displaceably mounted the shaft 31 which is hollow. This hollow shaft 31 possesses two grooves 35 arranged substantially diametrically opposite one another and possess an elongated angularly offset course, as best seen by referring to FIG. 4. Extending transversely through such grooves or channels 35 is a substantially cylindrical pin or peg 32 which is fixedly held in any convenient fashion at its ends in the gripper housing 28. At this pin 32 there bears one end of a spring 33 or equivalent structure which is arranged within the hollow shaft 31, the other end of such spring 33 bearing against the aforementioned mushroom-shaped end or pressure piece 34 which is constructed in the form of a screw. This spring or spring member 33 downwardly biases or presses the shaft 31, the pin or pin member 32 serving as the bottom limit stop. If the pin 32, when carrying out its function, is located at the upper terminal or end region of the grooves 35, then the lower clamping or clamp jaw 37 is directed towards the side, and in the showing of FIG. 3 towards the side of the guide means 14. This lower clamping jaw, when in the just-mentioned position, forms an angle with the upper clamping or clamp jaw 36 which, considered with respect to the direction of movement thereof is rearwardly directed (in the showing of FIG. 3 towards the observer) and is fixedly anchored at the gripper housing 28 which is closed at its upper end by a cover or cover member 44.

Now from the depicted open position the shaft 31, depending upon the thickness of the article or product to be seized, can be upwardly displaced merely against the resistance of the spring 33, otherwise without any other resistance coming into play. A return displacement is prevented by the provision of the blocking or locking pawl 38. This locking pawl 38 is retained by the small plate 39 which engages with somewhat play over the one end of the locking pawl 38 and itself is anchored at the housing 28, for instance by means of the threaded screw or bolt 39*a* or equivalent structure, as best seen by referring to FIG. 3. A spring 40 or the like retains the locking pawl 38 in a slight canted or inclined position in which position the locking pawl 38 is canted against the shaft 31 in order to retain such shaft against a downward displacement in each position above the open position. Conversely, however, and as already alluded to above, the shaft 31 can be readily shifted out of the open position upwardly, since the locking pawl 38 can be frictionally entrained against the biasing action of the spring 40, so that the canting position is released. Moreover, the canting of the locking pawl 38 can be equally released by an upwardly acting external force in order to eliminate the blocking of the shaft 31 in its closed position. If this happens, then, the shaft 31 is pressed downwardly by the spring 33 and with the aid of the grooves 35 is simultaneously rotated in such a manner that the lower clamping jaw 37 is shifted out of the position where it coincides or underlies the upper clamping jaw 36, i.e., assumes the position illustrated in FIG. 3. In order to actuate the locking pawl 38 there is threaded or othewise connected at its free end a flexed or angled projection 42 which coacts with actuation cams, control curves and the like which are arranged along the course of the path of travel or movement of the grippers. According to the showing of FIG. 3 there is provided in this connection a roller or roll 43 which, with the aid of a pneumatically actuatable lifting mechanism 41, can be raised out of its illustrated ineffectual position, so that the projection or protruding member 42, while subjected to the action of the roller 43, is continuously upwardly rocked or shifted together with the locking pawl 38. At all locations where there are provided such rollers it is thus possible to release the articles or products which previously were being transported in the engaged or clamped condition. By providing a suitable control it is possible to insure that certain products or a predetermined number or group of products will be "deposited" at one or a number of desired locations.

Figure 5:
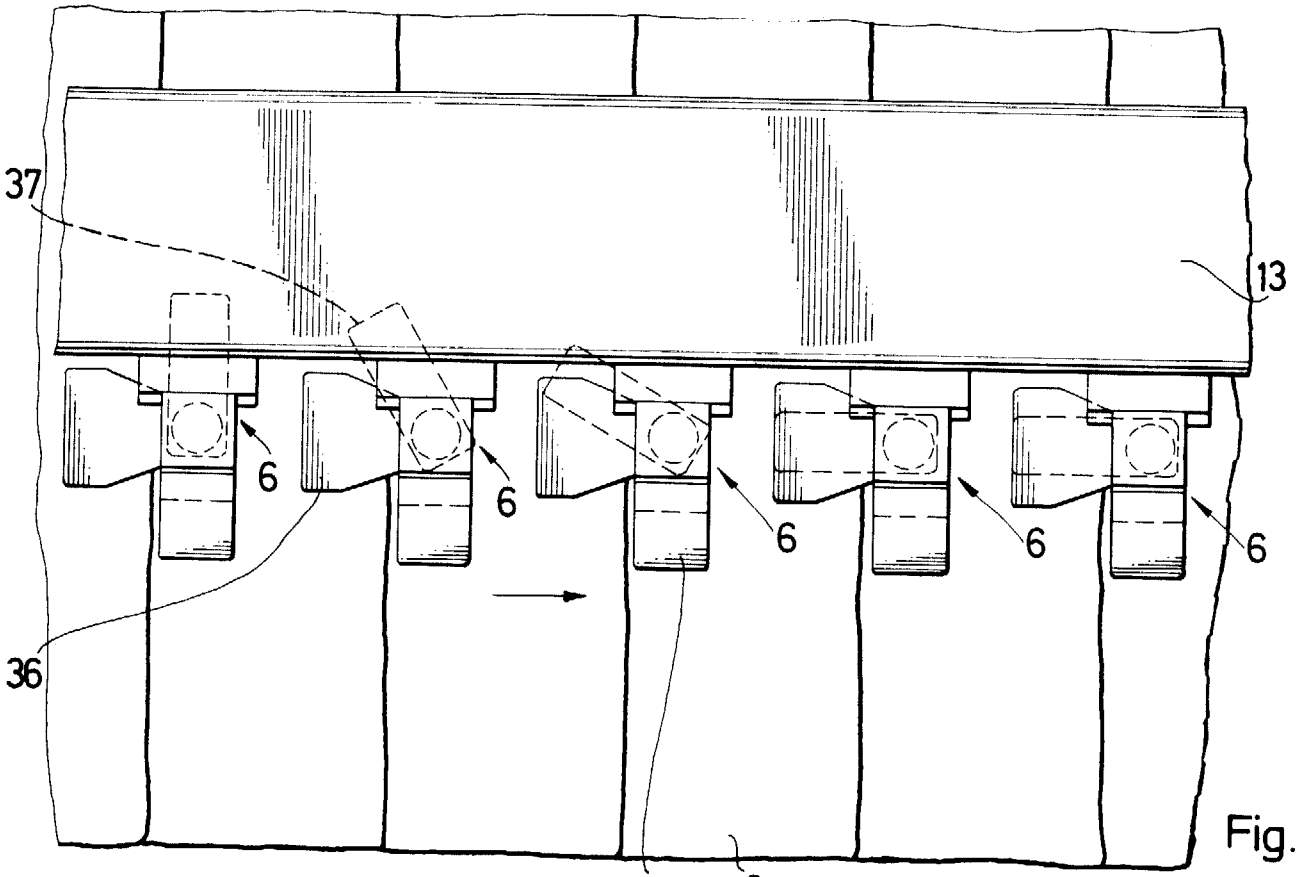
FIG. 5 is a plan view of the receiving station illustrated from the side in FIG. 1.
Figure 6:
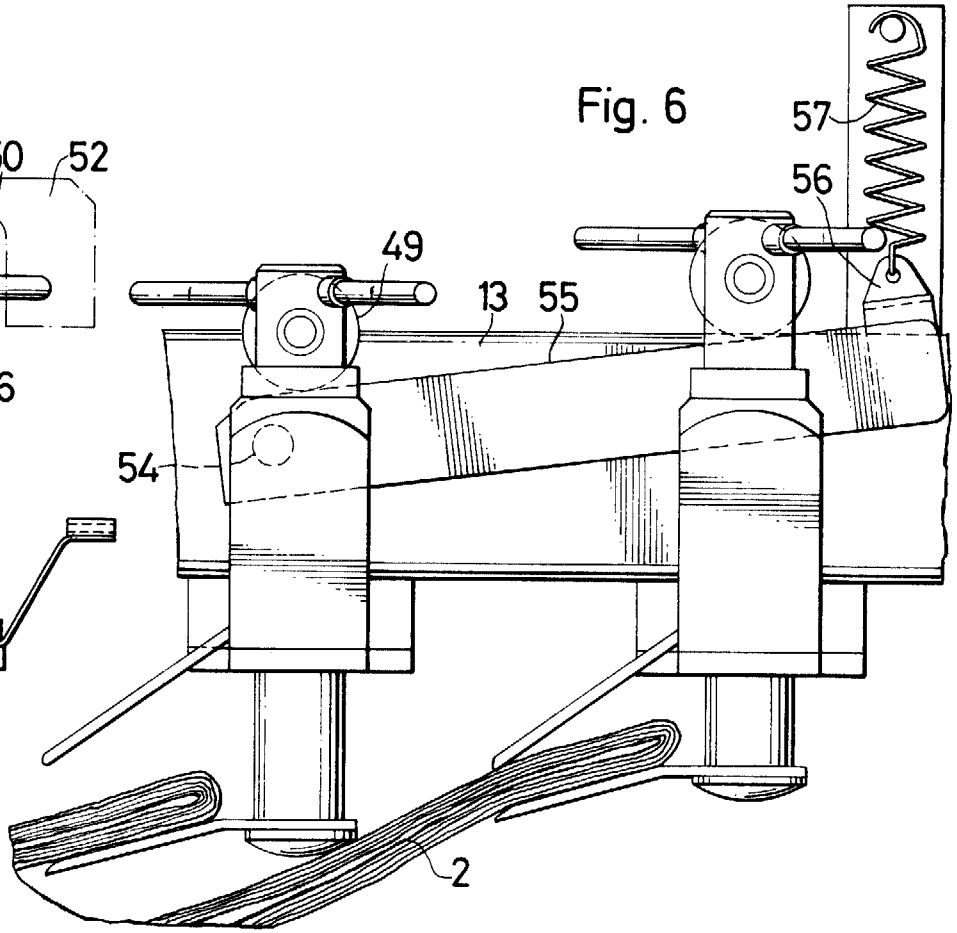
FIG. 6 is a side view of another embodiment of the grippers of the transport apparatus of this development.
Figure 7:
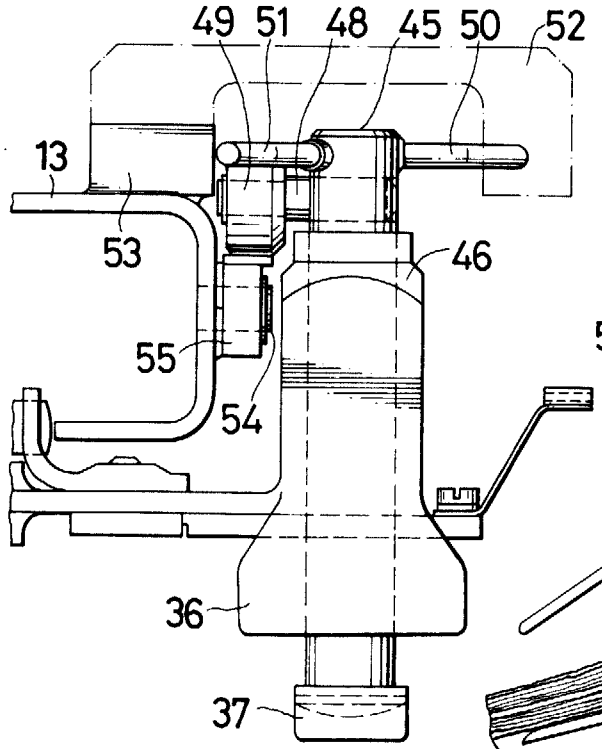
FIG. 7 is a view looking in the direction of conveying of the articles of such variant construction of gripper shown in FIG. 6.
Figure 8:
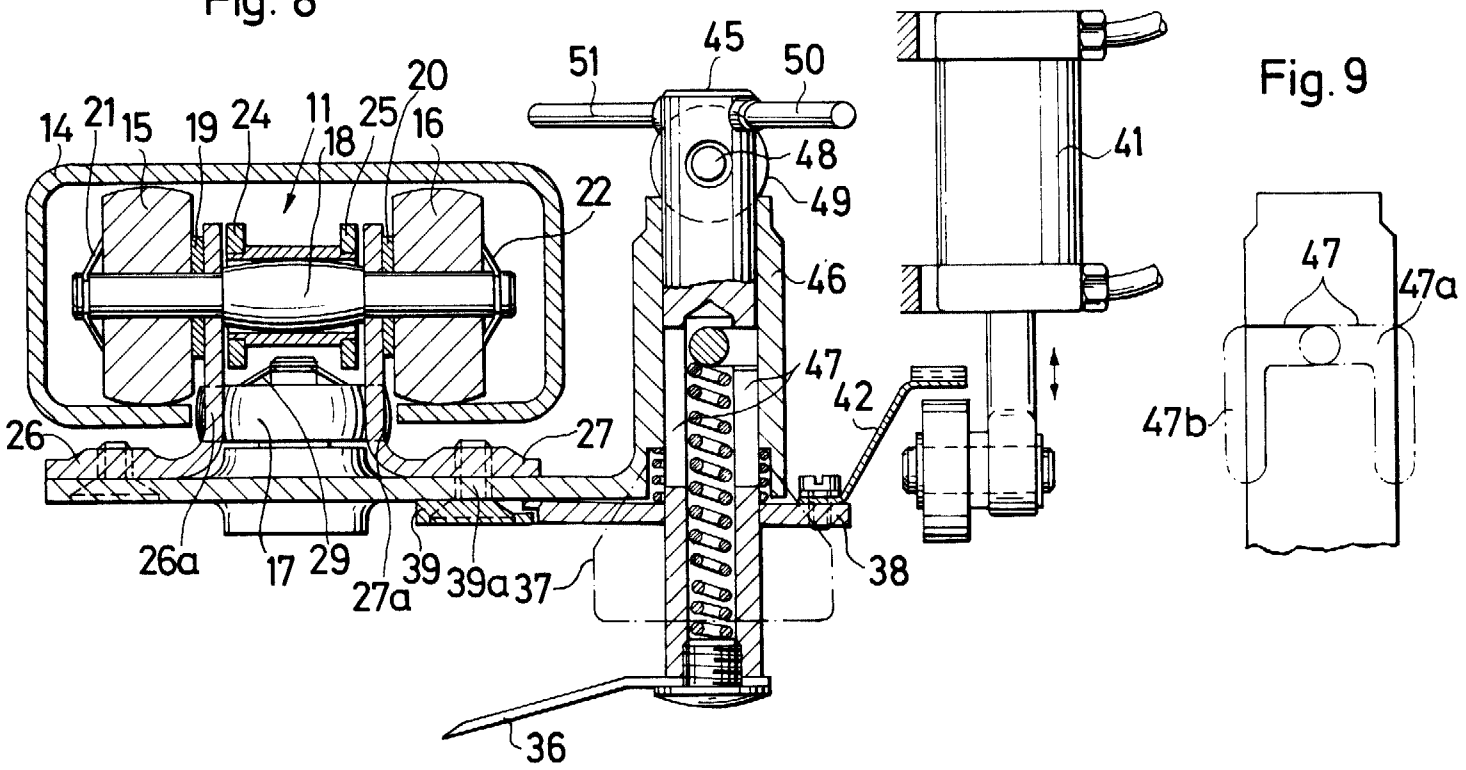
FIG. 8 is a cross-sectional view, corresponding to the showing of FIG. 3, however relating to the embodiment of gripper or gripper element shown in FIGS. 6 and 7 and at the transfer station.
Figure 10:
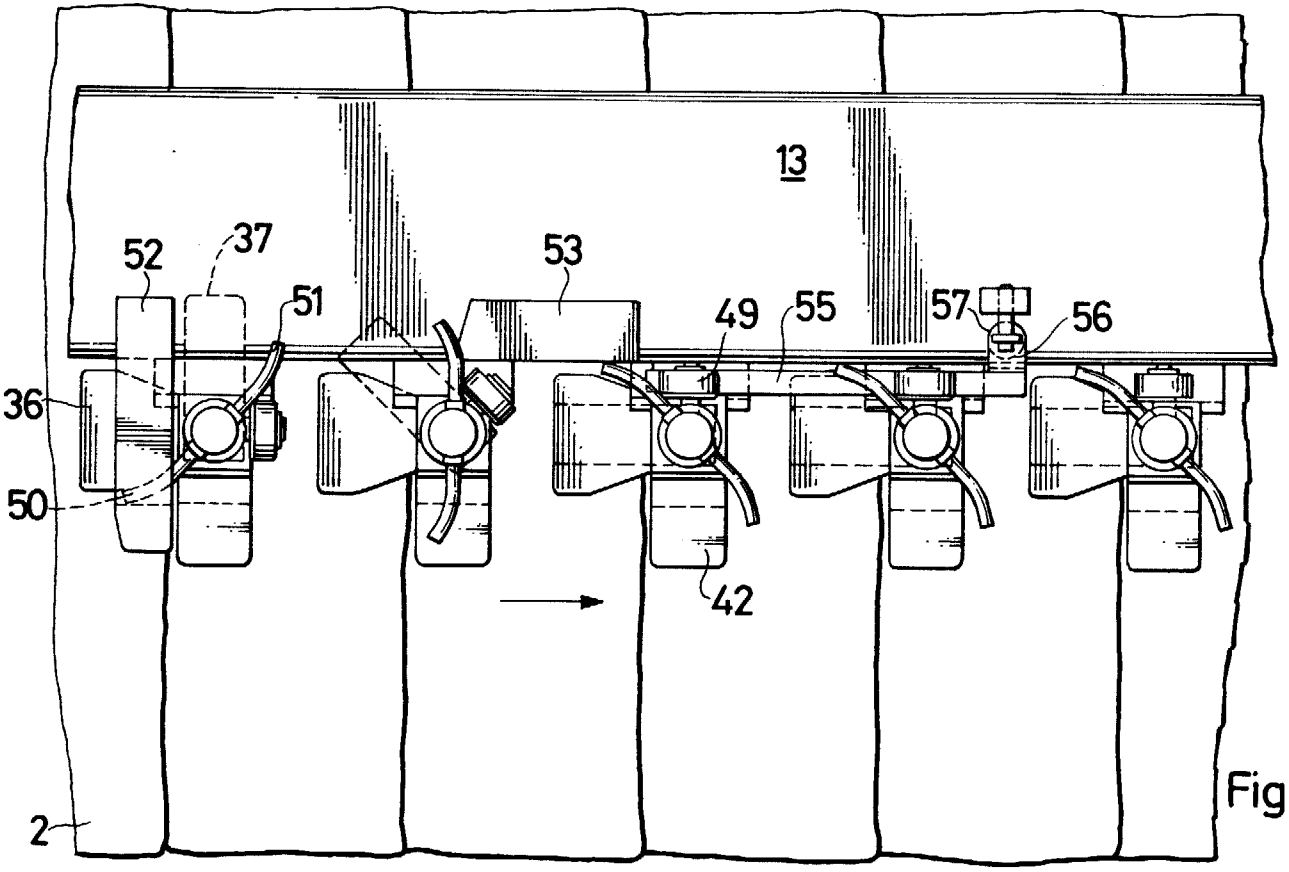
FIG. 10 is a plan view of the structure shown in FIG. 6 on a reduced scale, the illustration portraying the closing operation for the second embodiment of gripper construction.

At this point there will be briefly described the transfer or reception of the products 2, which can be assumed to be constituted by newspapers, periodicals or the like. Based upon the showing of FIGS. 3, 4 and 5 there will be explained in detail at this point the relevant operations. FIG. 5 illustrates different phases of the closing operation in conjunction with the grippers or gripper elements 6 which can assume the correspondingly illustrated positions. Viewing FIG. 5 from the left-hand side towards the right-hand side thereof it will be recognized that the first gripper 6 is still in its open position. The closing operation is already in progress inasmuch as the shaft 31, as previously explained, bearing upon the leading edge of a product copy which is entrainably moved along with the imbricated product stream has been pressed slightly upwardly. At the second gripper 6 the displacement of the shaft 31 has proceeded upwardly already to such an extent that the pin 32 engages with the intermediate inclined directed region of the grooves 35 and there is initiated the rotation of the lower clamping jaw 37. This lower clamping jaw 37 thus progressively engages with the leading edge of a product copy, as the same has been schematically represented by the the third and fourth grippers or gripper elements 6 counted from the left-hand side of the showing of FIG. 5, and at which leading edge in the meantime there has also come into contact the upper clamping jaw 36. The axial extent of the grooves 35 now renders it possible to further press the shaft 31 in such a manner that it successfully brings about an effective clamping of the engaged or seized product copy. At locations provided for this purpose and where there are arranged the release mechanisms, such as for instance the lifting device or means 41, the clamping operation is annhilated and the previously clampingly seized product copy released.

Continuing, in FIGS. 6 to 10 inclusive there is illustrated a second exemplary embodiment of a gripper or gripper element and its actuation, wherein in contrast to the first embodiment previously discussed those components which are the same or analogous thereto have been generally provided with the same reference characters. Hence, in the description to follow there will be only discussed to the extent necessary the constructional and functional differences from the previous embodiment disclosed in detail.

Now with the exemplary embodiment of gripper as illustrated in FIGS. 6 to 10 the slide or slide member 45 carrying the lower clamping jaw or tongue 37 extends upwardly past the gripper or clamp housing 46. At this upper end of the slide 45 there is mounted a bolt member 48 carrying a roller member or roll 49. Furthermore, at this end of the slide or slide member 45 there are located two arm members or arms 50 and 51 which are directed away from one another, as shown, and these arm members serve the purpose of imparting to the slide 45 a rotational movement in the one or the other rotational sense or direction. In order to render such possible, in this case the grooves 47 are formed at right angles to one another, as best seen by referring to FIG. 9, and each such groove 47 possesses a leg portion 47*a* extending in the peripheral direction in order to impart the requisite rotational movement and an axially directed leg portion 47*b* for imparting the requisite displacement movement to the slide 45 which can also be considered to constitute a shaft or shaft member. In order to turn-out the lower clamping jaw or tongue 37 out of the closed position wherein such underlies or substantially coincides with the upper clamp or clamping jaw or tongue 36 the arm 50 coacts with an impact bracket or stop member 52 attached at the guide or guide means 13, as particularly well recognized by inspecting FIG. 10. Serving to turn-in or inwardly rotate the lower clamping jaw or tongue 37 into the closed position of the gripper is the arm 51 as well as a stop or impact member 53 which is likewise attached to the guide means 13. It will be apparent from an inspection of FIG. 10 that with the aid of such impact or stop member 53, and during such time as the relevant gripper travels past the same, the lower clamping jaw 37 is rotated into its closed position and in accordance with the length of such impact or stop member 53 retained in this position. Following the impact or stop member 53 there is located along the path of movement of the grippers a rocker arm or link 55 which is pivotably mounted at a bolt 54 or the like and is suspended at its free end with the aid of a clamp 56 at a spring 57 or equivalent structure. This rocker arm 55 is located in the path of movement of the roller member 49 of each gripper, and which upon movement of the relevant gripper along such rocker arm 55 the roller member 49 is raised thereby. Consequently, the lower clamping jaw 37 is advanced towards the upper clamping jaw 36 and the product copy or article is engageably seized.

In order to close each gripper or gripper element the lower clamping jaw or tongue 37 is rotated into the closed position with the aid of the impact or stop member 53 and the arm 51. Thereafter the closing operation is carried out with the aid of the rocker arm 55. In the same manner as with the first discussed exemplary embodiment, also in this case the slide or shaft 45 is locked in the closed position by means of a locking or blocking pawl 38 or equivalent structure. For releasing the product copies there is also required in this case a lifting device 41 or equivalent structure or for instance equally functional cams, links or the like. After the locking pawl 38 has been released then the relevant gripper travels past an impact or stop bracket 52 (reference being made particularly to the left-hand portion of FIG. 10), which by means of the arm 50 again rotates the lower clamping or clamp jaw 37 towards the side.

Figure 11:
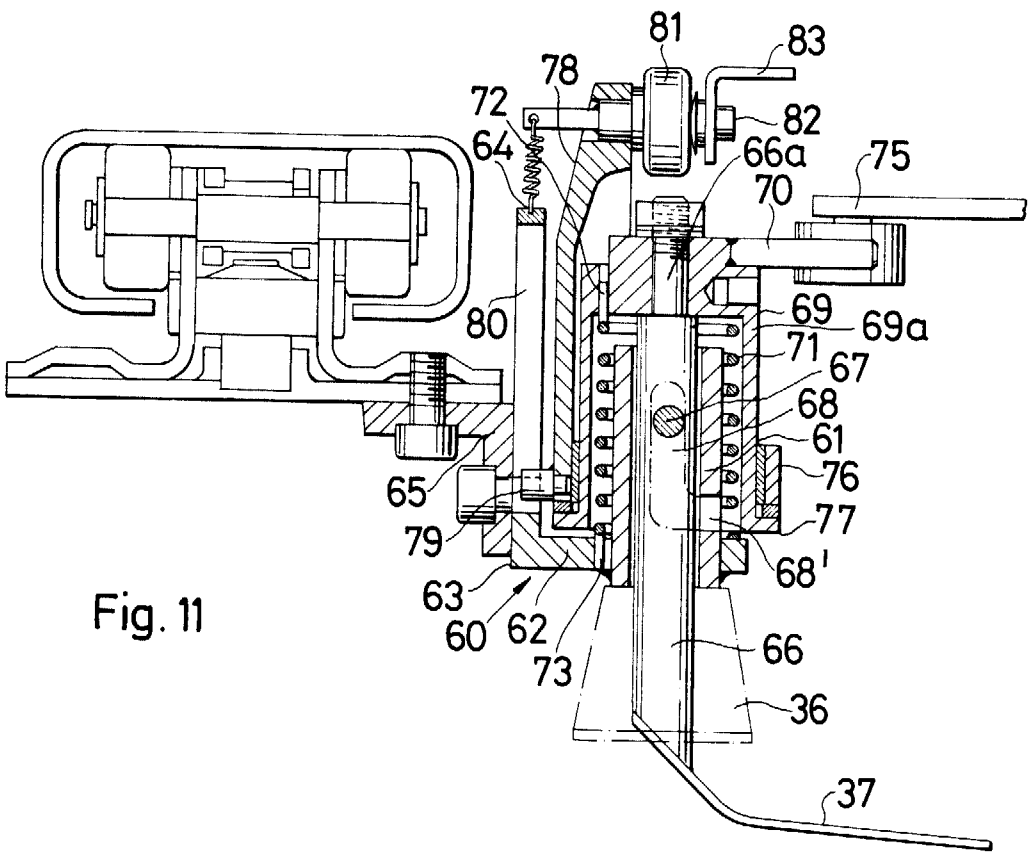
FIG. 11 is a cross-sectional view corresponding to the showing of FIG. 3, however relating to a third constructional embodiment of gripper or gripper element.

A further embodiment of the invention has been shown in sectional view in FIG. 11. The description to follow will be conveniently limited to the differences in contrast to the already described exemplary embodiments. With this constructional modification the gripper housing 60 possesses a sleeve 61 which is attached at the lower leg 62 of an angular-shaped or angled bracket or console 63. The vertical leg 64 of the bracket 63 is anchored by means of an angular member 65 at the transport or conveying chain. In the sleeve 61 there is guided the shaft 66 of the lower clamping jaw 37, whereas the upper clamping jaw 36 is attached to the sleeve 61. The shaft 66 is pierced by a transversely extending pin or pin member 67 which engages by means of its one end in a rectangular groove 68 of the sleeve 61. From what has been discussed above there is accordingly necessary an additional explanation: In accordance with the indicated position of the pin or pin member 67 the lower clamping jaw 37 must coincide with the upper clamping jaw 36. In the illustrated open position of the lower clamping jaw 37 the pin 67 must be located in the horizontal section or portion 68' of the slot 68. In any event it is clear that the shaft 66, as a function of the slot 68, can carry out a rotational movement and an axial movement.

The upper stepped end **66*a* of the shaft 66 piercingly extends through the floor or base of a substantially pot-shaped entrainment member 69 which is rigidly connected for rotation with an actuation arm 70 and encloses by means of its shell or jacket 69*a* the sleeve 61. Between the jacket or shell 69*a* of the entrainment member 69 and the sleeve 61 there is located a helical spring 71 or the like which is anchored by means of its one end at the floor of the entrainment member 69 at location 72. This helical spring 71 is anchored at its other end in the leg portion 62 of the housing 60, and specifically at location 73. The arrangement is undertaken such that the spring 71 on the one hand upwardly shifts or displaces the entrainment member 69 when the pin 67 is located in the vertical section of the slot 68, whereas, on the other hand, the same spring rotates the entrainment member such that the pin 67 engages into the horizontal section of the slot 68 when the entrainment member 69 with the shaft 66 is downwardly vertically pressed into its terminal or end position. With the illustrated position of the entrainment member or sleve 69 pin 67 must be located in the horizontal section 68' of the slot 68. With the aid of the arm 70, when the same travels against a rocker arm or link indicated by reference character 75, the shaft 66 together with the entrainment member 69 is then rotated against the action of the spring 71, so that the pin 67 is retracted out of the horizontal section 68'. The vertical section of the slot 69 then frees towards the top the path for the pin 67, so that the shaft 66 can be upwardly shifted via the sleeve 69 by means of the spring 71. The lower clamping 37 which has been brought into coincidence or underlying relationship with the upper clamping jaw 36 owing to the previously carried out rotation then can engage the leading edge of a product copy or article and holds such under the action of the spring 71**.

In order to open the gripper 60 the entrainment member 69 together with the shaft must be pushed downwardly, whereupon the spring brings about the outward rotation of the lower clamp or clamping jaw 37 and the latter is maintained blocked in this position in coaction with the horizontal section or portion 68' of the slot 68. In order to downwardly press the sleeve or sleeve member 69 there is provided a ring 76 which encloses or surrounds outer shell or jacket **69*a* of the entrainment member 69 and is guided to be lengthwise displaceable therealong. This ring or ring member 76 cooperates with a shoulder 77 of the entrainment member 69 in order to displace the same downwardly. Ring member 76 carries a segment-shaped web 78 which is guided by means of a pin 79 in a guide groove 80 of the vertical leg 64 of the bracket or console 63. At the web 78 there is mounted a roller member or roll 81 which in operable coaction with a rocker arm or link serves the purpose of displacing the entrainment member 69 downwardly via the ring 76 when the gripper 60 should be open. The shaft 82 defining the axis of rotation for the roller 81 carries an angle-shaped projection 83. This coacts with a deflection mechanism in such a manner that the roller 81, with the gripper closed, at the region of a ramp which otherwise downwardly presses the roller 81, raises such roller and such travels over such ramp or rocker arm, with a result that the gripper 60** moves past the relevant transfer or deposit location without releasing the entrained product copy or article.

In summation the mode of operation of the gripper or clamp 60 is as follows: In the open position the pin 67 is retained in the horizontal section or portion of the slot 68. If the shaft 66 is rotated with the aid of the arm 70, then the pin 67 arrives at the region of the vertical leg of the slot 68 and the spring 71 brings the lower clamped jaw 37 which has been rotated into its effective position into the closed position. If the shaft 66 is downwardly pressed, then, the lower clamp or clamping jaw 36 is rotated towards the side by the spring 71 and held in this position. The closing and opening of the gripper takes place with the aid of rocker arms or links or equivalent structure at which the grippers move past, wherein the roller 81 provided for the opening operation when the gripper is closed is lifted with the aid of a further rocker arm or link or the like when the gripper is not intended to be opened at a given deposit or transfer location.

Figure 12:
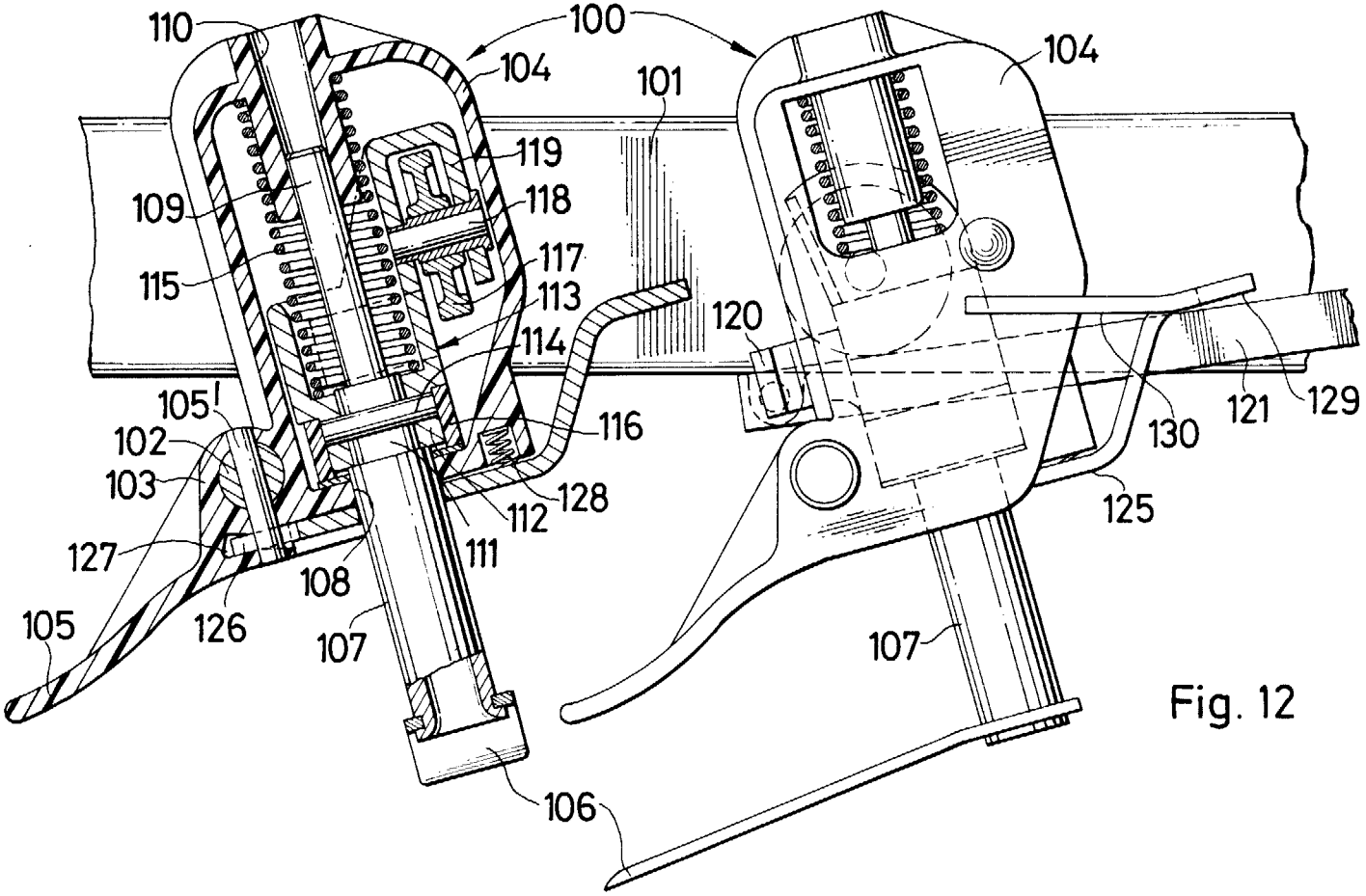
FIG. 12 illustrates a section of the transport apparatus equipped with modified grippers or gripper elements, partially shown in sectional view, and portrayed in different operational positions.
Figure 13:
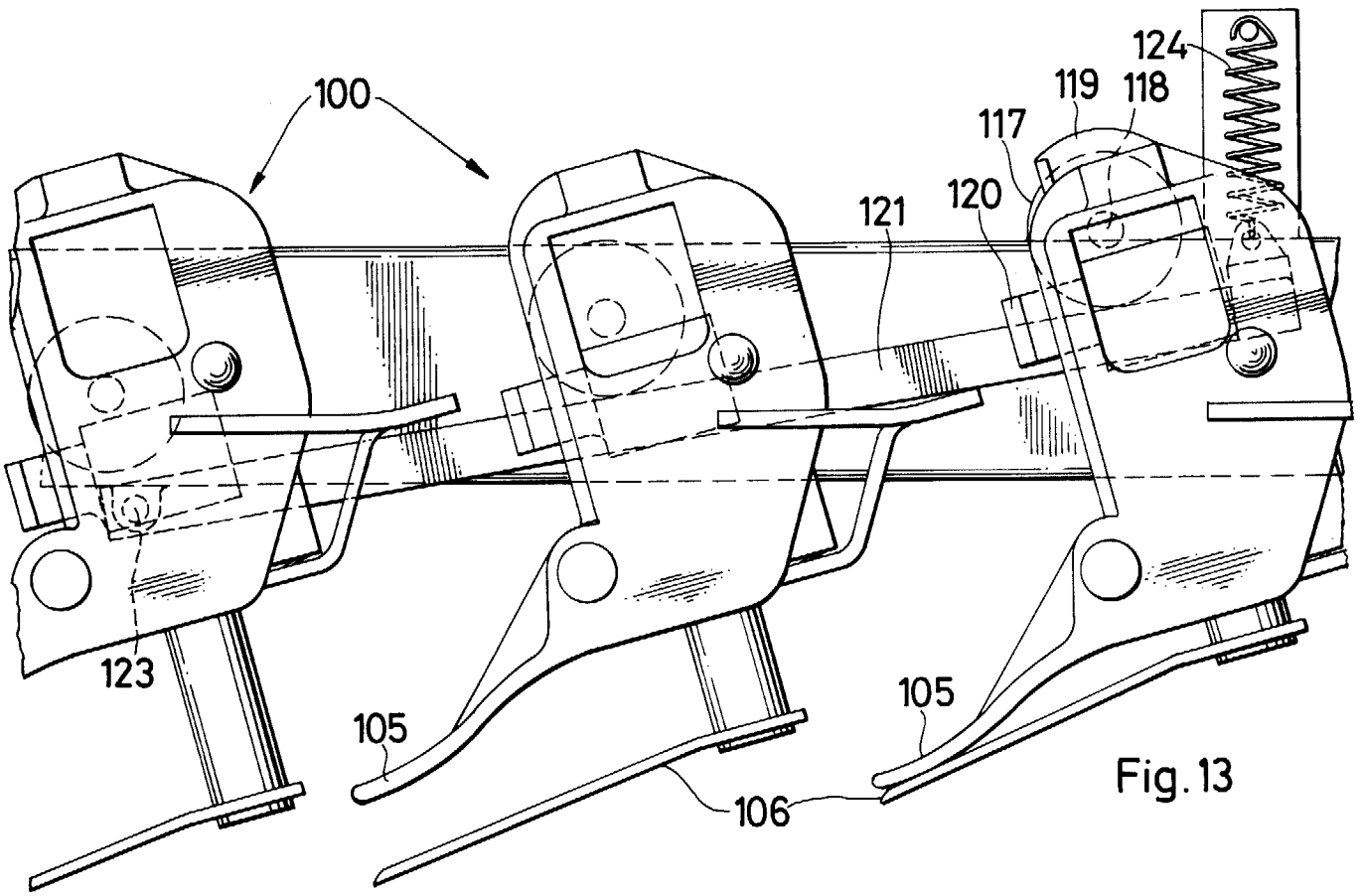
FIG. 13 illustrates a section of the transport apparatus which merges with the section of the transport apparatus shown in FIG. 12 and with the grippers shown during the course of carrying out their closing movement.
Figure 14:
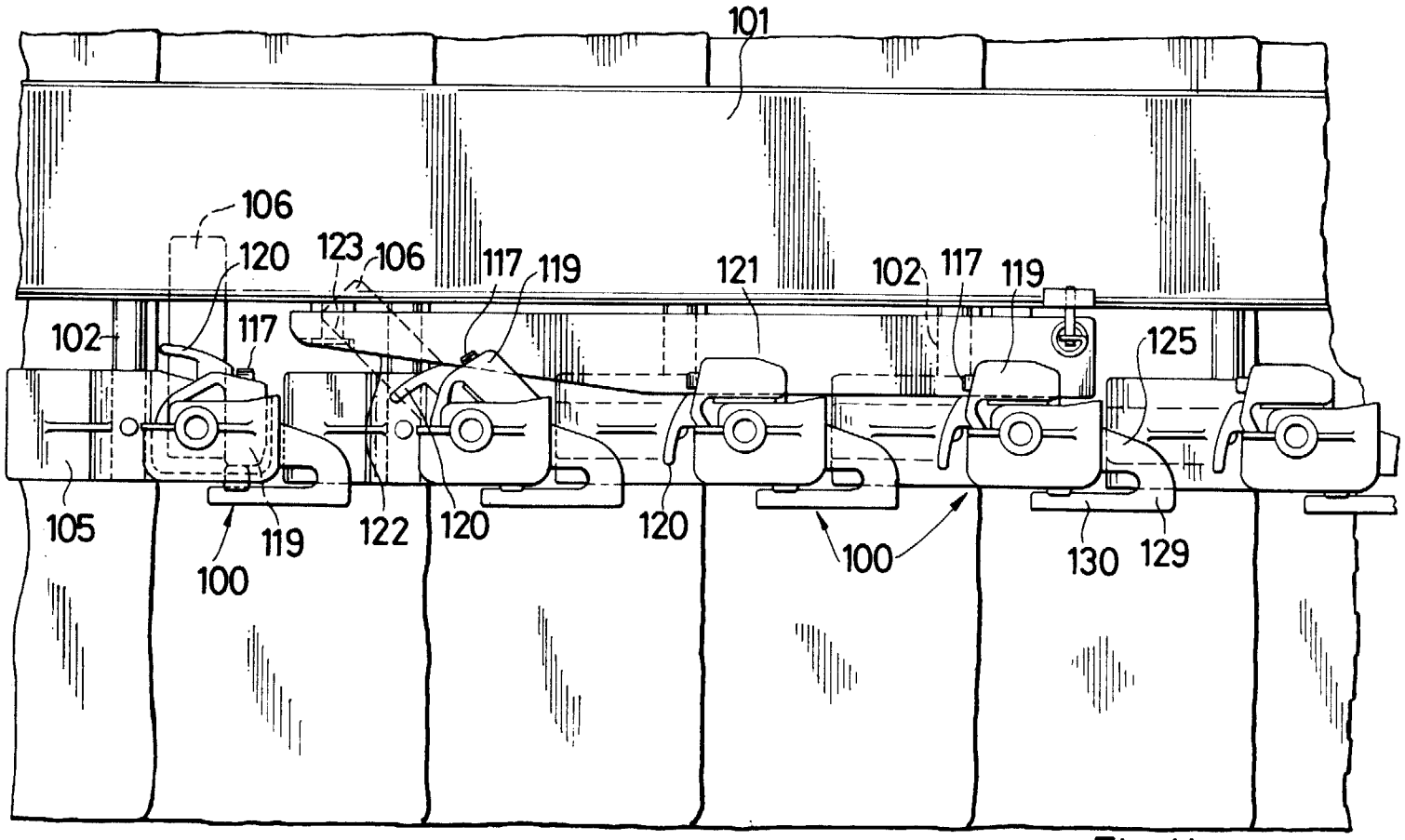
FIG. 14 is a plan view analogous to the showing of FIG. 5, but relating to the structure of FIGS. 12 and 13 and shown on a reduced scale.

The embodiment portrayed in FIGS. 12, 13 and 14 differs from the previously described exemplary embodiments only in the construction of the grippers which in these Figures have been designated in their entirety by reference character 100. Each of these grippers 100 are attached at the chain which is not visible in FIGS. 12 to 14 because such chain is presently traveling within the guide means 101, by means of a bolt 102 or the like (see FIGS. 12 and 14), each such bolt engaging with its one end in an eyelet 103 of the associated clamp housing 104 and being fixedly positionally held at that location by means of a pin 105' or the like. A projection of the eyelet 103 simultaneously forms the stationary upper clamping jaw 105 of the gripper 100. The gripper housing 104 including the eyelet 103 and the upper clamping jaw are preferably formed as a one-piece component from plastic.

The lower clamping jaws or tongues 106 of the grippers 100 are secured to an associated shaft 107 which is guided to be lengthwise displaceable and rotatable in a bore 108 of the housing 104 and with its stepped end section 109 in a guide or guide means 110 of the housing 104. Each shaft 107 has mounted in front of the end or terminal section 109 a bearing seat 111 which is enclosed by a bearing sleeve 112 of a pivotable or pivotal portion 113. This pivotal portion 113 is fixedly connected with the shaft 107 by means of a pin 114 or the like. Accordingly, the force of a compression or pressure spring 115, which bears at one end at the housing 104 and at the other end at the pivotal portion 113, is transmitted to the shaft 107, with the result that the movable clamping jaw 106 is urged or pressed in the direction of its open position. In this connection a sleeve 116 formed for instance of rubber which encloses the bearing sleeve or bushing 112 or formed of a similar material serves as a stop at the floor of the housing 104. Since the ends of the spring 115 are anchored against rotation at the housing 104 at the pivotal portion 113, respectively, and the spring is mounted in a pre-stressed condition not only in its axial direction but also in the peripheral direction, at each gripper the lower clamping jaw in its open position is held at an angle with respect to the upper clamping jaw 105. This is the case as illustrated for the left-hand gripper shown in FIGS. 12 and 14.

In the open position of the lower clamping jaw or tongue 106 there is located internally of the housing 104 a roller or roll 117 which is rotatably mounted by means of an axle 118 in a hollow projection 119 of the pivotal portion 113. As best seen by referring to FIG. 14, an actuation cam or dog 120 of the pivotal portion 113 protrudes laterally forwards towards the guide means 101. The actuation cam or dog 120 of the grippers 100 cooperate with a rocker arm or link 121 which is laterally attached at the guide or guide means 101, such rocker arm 121 possessing a beveled or inclined ramp 122 upon which travel the pivotal cams or dogs 120 of the grippers which are forwardly moving or advancing, in the showing of FIG. 14 from the left towards the right. Again as best seen by referring to FIG. 14 the pivotal portions 113 of the grippers are thus rocked or pivoted, so that the corresponding roller 117 is moved out of its associated housing 104. As a result the rollers 117 of the grippers 100, during the forward movement thereof, are raised by the rocker arm or link 121 which ascends in the forward direction of movement. The lower clamp or clamping jaw 106 of the gripper 100 which has been brought into substantial coincidence or underlying relationship with respect to the therewith cooperating upper clamping jaw 105, due to rocking of the pivotal portion 113, is thus raised into its closed position. This operation can be readily understood on the basis of FIG. 13. By referring thereto it will be seen that the rocker arm or link 121 is pivotably mounted at location 123 at the guide or guide means 101 and is held in the inclined position by means of a tension or traction spring 124. This arrangement, among other things, serves the purpose of compensating thickness differences of the processed products or articles, such as typically newspapers, periodicals or the like.

At each gripper 100 the lower clamping jaw 106 is fixedly held in its closed position by means of the locking or blocking pawl 125 which is tiltably held by means of its bifurcated or forked end 126 in a recess 127 of the eyelet 103, so that it can cant or tilt under the action of a pressure or compression spring 128 and thus can fixedly hold the shaft 107 against the action of the spring 115, and which shaft piercingly extends through a bore of the locking pawl 125. If, however, the locking pawl 125 is retracted out of its canted position, then, the spring 115 can displace the shaft 107 and at the same time rotate the same and thus bring the lower clamping jaw 106 out of its closed position into its open position. In order to bring about this operation each locking pawl 125 possesses a projection 129 which is positioned at an inclination with respect to the direction of movement of the grippers and which projection 129 transforms into a flat supporting web 130 which extends in the direction of gripper movement. In the path of movement of the components 129 and 130, respectively, there are located at predetermined positions deflection elements, for instance in the form of rollers (basically corresponding approximately to the arrangement of FIG. 3 or FIG. 8), by means of which the locking pawl 125 of the grippers 100 can be rendered ineffectual or inoperative.

The mode of operation of this exemplary embodiment should be readily understood based upon the above discussion of the construction of this embodiment, also in view of the comments made with respect to the previously discussed remaining embodiments, and therefore need only be briefly recapitulated: By carrying out an appropriate alignment of the path of movement of the grippers such are advanced to the imbricated product stream (as such is apparent from the showing of FIG. 1, and wherein preferably there is employed the rocker arrangement 3). Then when the upper clamping jaw 105 comes to bear at the leading edge of the printed product (compare FIG. 14), the lower clamping jaw is rocked inwardly below the aforementioned leading product edge, raised into the closed position and held in this position by the associated locking pawl. Consequently, the printed products or the like have been individually seized by the grippers. After completion of the desired conveying thereof they can be released in their entirety or selective ones of such printed products can be released.

In all of the exemplary embodiments heretofore discussed the grippers are advanced to the location of the imbricated product stream in such a manner that the upper clamping jaw engages over the leading edge of the product copy or article which is to be seized or engaged. Thereafter the lower clamping jaw is turned inwardly below the aforementioned product edge, and specifically either by pressing the gripper against the supporting surface of the imbricated product stream or with the aid of stationary rotational stops. Simultaneous therewith or subsequent thereto there also occurs the advancement or placement of the lower clamping jaw at the region of the upper clamping jaw, and the thus brought about closed position is maintained either by means of a locking device or by spring force. Basically, the thickness of the product is of no significance. This will be readily appreciated particularly when the positioning of the lower clamping jaw is carried out with the assistance of a spring force. Also with the initially described variant constructions what has been stated above is equally applicable, since the shaft of the lower clamping jaw in both instances can be blocked in each displaced position and the jaws can be preferably fabricated of elastic or resilient material.

With a transport apparatus as constructed in accordance with the teachings of this development the transport or conveying of the imbricated product formation can be readily converted into an individual transporting of the product copies or the like, in other words a mass transport can be easily converted into an individual transport of the products being handled, and which furthermore can be still collectively additionally transported or conveyed, yet can be individually deposited or released from their transport mechanism at appropriately designed transfer or delivery stations.

Moreover, the comments which have been made with regard to the exemplary embodiments discussed with reference to FIGS. 1 to 11 are also analogously applicable for the embodiment considered with respect to FIGS. 12 to 14.

While there is shown and described present preferred embodiments of the invention, it is to be distinctly understood that the invention is not limited thereto, but may be otherwise variously embodied and practiced within the scope of the following claims.

What is claimed is:

1. A transport apparatus for products, especially printed products arriving in an imbricated product formation, comprising a revolving traction element, grippers for engaging the leading edges of the printed products and for seizing the same for the further transport thereof, means for mounting said grippers in spaced relationship from one another at said revolving traction element for movement in a predetermined direction of travel, means defining a conveying path for the imbricated product formation for movement in a predetermined direction of travel, guide means for guiding said grippers, said means defining said conveying path for the imbricated product formation and said guide means for the grippers extending towards one another at a transfer zone for the imbricated product formation, each gripper comprising an upper clamping jaw and a lower clamping jaw, means for mounting the lower clamping jaw to be movable towards and away from the upper clamping jaw and for enabling rotational movement of said lower clamping jaw, said lower clamping jaw being movable between an open position and a closed position, the upper clamping jaw being rearwardly directed with respect to the direction of travel of the grippers, said lower clamping jaw forming with the upper clamping jaw an angle when the lower clamping jaw is in its open position and when said lower clamping jaw is in its closed position said lower clamping jaw being positionally oriented to substantially underlie the upper clamping jaw, means for holding the lower clamping jaw in said substantially underlying position with regard to the upper clamping jaw, means provided at the region of the transfer zone in order to displace the lower clamping jaw through rotation and displacement thereof into its closed position, and means arranged along the path of travel of the grippers in order to render inoperable the holding means and to return the lower clamping jaw back into its open position.

2. The transport apparatus as defined in claim 1, wherein said mounting means for the lower clamping jaw of each gripper incorporates a shaft at which there is mounted the lower clamping jaw, a housing at which there is mounted the upper clamping jaw, said means for displacing the lower clamping jaw includes means for mounting said shaft in said housing for rotation about its lengthwise axis and for displacement thereof in the direction of said lengthwise axis of the shaft.

3. The transport apparatus as defined in claim 2, wherein said displacing means for the lower clamping jaw includes a helical spring, said shaft being substantially coaxially arranged with respect to said helical spring, the lower clamping jaw assuming a rotational position corresponding to the open position of the lower clamping jaw under the action of said helical spring.

4. The transport apparatus as defined in claim 3, wherein said helical spring has opposed ends which are fixed at said housing and at said shaft, said spring being pre-biased in the circumferential direction thereof.

5. The transport apparatus as defined in claim 3, wherein said shaft is provided with a transversely extending pin, gripper closure impact means arranged in the path of movement of the pin, said pin cooperating with said gripper closure impact means in order to pivot the lower clamping jaw out of its open position.

6. The transport apparatus as defined in claim 5, further including an actuation roller carried by said shaft, operating means for said actuation roller arranged behind the gripper closure impact means in the direction of transport of said grippers, said actuation roller in the underlying position of the lower clamping jaw traveling upon said roller operating means.

7. The transport apparatus as defined in claim 6, wherein said roller operating means comprises rocker arm means which ascend in the direction of transport of the grippers.

8. The transport apparatus as defined in claim 7, further including spring means for resiliently retaining said rocker arm means against downward movement thereof.

9. The transport apparatus as defined in claim 3, wherein said shaft assumes a lower terminal position directed towards the conveying path for the imbricated product formation under the action of the helical spring, said holding means including locking means provided for said shaft for fixedly retaining said shaft against the action of the helical spring in each displaced position of said shaft.

10. The transport apparatus as defined in claim 9, further including means for rendering inoperable said locking means, said inoperable rendering means being arranged along the path of travel of said locking means.

11. The transport apparatus as defined in claim 10, further including actuation means for returning the means rendering inoperable the locking means back out of its effectual position.

12. The transport apparatus as defined in claim 9, wherein said mounting means for said shaft for the rotation and displacement thereof embodies guide pin means and guide groove means for guiding said shaft to be rotatable about the lengthwise axis of said shaft and for the displacement thereof in the direction of said lengthwise axis of the shaft.

13. The transport apparatus as defined in claim 12, wherein said guide groove means includes an inclined peripheral section merging with an axial section, pressure means provided at the lower end of the shaft and possessing a path of travel which converges with respect to the conveying path for the imbricated product formation, so that the lower clamping jaw due to axial displacement of the shaft can be rotated into its closed position through the coaction of said pressure means at the lower end of the shaft and the means defining the conveying path for the imbricated product formation.

14. The transport apparatus as defined in claim 12, wherein said transversely extending pin extends to both sides of the shaft to form respective arms, and in the direction of shaft movement following the means rendering inoperable said locking means there are provided return rotational impact means cooperating with one of the arms of the transversely extending pin in the lower position of the shaft.

15. The transport apparatus as defined in claim 5, wherein the helical spring exerts a closing force in the axial direction of the shaft, said mounting means for said shaft includes guide pin means for guiding said shaft, a guide groove cooperating with said guide pin means, said guide pin means in the open position of the lower clamping jaw being located in a peripheral section of the guide groove, and the transversely extending pin inwardly rotating the lower clamping jaw at the region of an axial section of the guide groove.

16. The transport apparatus as defined in claim 15, further including roller means for displacing the shaft against the action of the helical spring.

17. The transport apparatus as defined in claim 16, wherein said roller means is operatively connected with said shaft by drag connection means and thus can be shifted out of its operable position.

18. The transport apparatus as defined in claim 1, wherein said means defining the conveying path at the transfer zone is constructed as a rocker arrangement which can be freely unloaded in the direction of conveying of the imbricated product formation, and means providing a spring force for pivotably urging the rocker arrangement in the direction of the gripper guide means.

* * * * *